US010260320B2

(12) United States Patent
He

(10) Patent No.: US 10,260,320 B2
(45) Date of Patent: Apr. 16, 2019

(54) HORIZONTAL WELL COMPLETION TUBING STRING CAPABLE OF ACHIEVING SUBLEVEL MINING

(71) Applicant: Sichuan Xingzhi Zhihui Intellectual Property Operation Co., Ltd., Chengdu, Sichuan (CN)

(72) Inventor: Changming He, Sichuan (CN)

(73) Assignee: Sichuan Xingzhi Zhihui Intellectual Property Operation Co., Ltd., Chengdu (CN)

( * ) Notice: Subject to any disclaimer, the term of this patent is extended or adjusted under 35 U.S.C. 154(b) by 0 days.

(21) Appl. No.: 15/560,500

(22) PCT Filed: Oct. 14, 2016

(86) PCT No.: PCT/CN2016/097424

§ 371 (c)(1),
(2) Date: Sep. 22, 2017

(87) PCT Pub. No.: WO2017/193502

PCT Pub. Date: Nov. 16, 2017

(65) Prior Publication Data

US 2018/0187523 A1 Jul. 5, 2018

(30) Foreign Application Priority Data

May 11, 2016 (CN) ..... 2016 1 0309039

(51) Int. Cl.

| | |
|---|---|
| ***E21B 43/08*** | (2006.01) |
| ***E21B 43/24*** | (2006.01) |
| ***E21B 43/30*** | (2006.01) |
| ***E21B 43/34*** | (2006.01) |
| ***E21B 43/00*** | (2006.01) |
| ***E21B 43/12*** | (2006.01) |

(52) U.S. Cl.

CPC ..... *E21B 43/08* (2013.01); *E21B 43/00* (2013.01); *E21B 43/12* (2013.01); *E21B 43/24* (2013.01); *E21B 43/305* (2013.01); *E21B 43/34* (2013.01)

(58) Field of Classification Search

CPC ..... E21B 43/08

See application file for complete search history.

(56) References Cited

U.S. PATENT DOCUMENTS

2014/0262260 A1* 9/2014 Mayer ..... E21B 43/08 166/278

2016/0369602 A1* 12/2016 Frosell ..... E21B 33/12

* cited by examiner

*Primary Examiner* — David J Bagnell
*Assistant Examiner* — Brandon M Duck

(57) ABSTRACT

A horizontal well completion tubing string capable of achieving sublevel mining comprises a production casing. A horizontal section of the production casing is connected to two primary screen pipes. A pumping pipe is fixed in a vertical section of the production casing via a packer. A horizontal section of the pumping pipe extends freely in a horizontal well section constituted of the two primary screen pipes and the casing. A secondary screen pipe is disposed on the horizontal section of the pumping pipe. Meshes of the secondary screen pipe each comprises a reduced section, a straight section and an impact section, wherein an inner diameter of the reduced section is reduced outwardly along the radial direction of the secondary screen pipe, and an inner diameter of the impact section is reduced outwardly along the radial direction of the secondary screen pipe.

6 Claims, 4 Drawing Sheets

HORIZONTAL WELL COMPLETION TUBING STRING CAPABLE OF ACHIEVING SUBLEVEL MINING

FIELD OF THE INVENTION

The present invention relates to the technical field of oil recovery in horizontal wells, and more particularly relates to a horizontal well completion tubing string capable of achieving sublevel mining.

BACKGROUND OF THE INVENTION

Thick oil is an important constituent of hydrocarbon energy, and its characteristics are as follows:

Thick oil contains high contents of colloid and asphalt and low content of light fractions. Meanwhile, the relative density and viscosity of thick oil increase with the increase in the contents of colloid and asphalt.

The viscosity of thick oil is particularly sensitive to temperature. The viscosity decreases sharply with the increase in temperature, and such phenomenon is more significant in crude oil with higher viscosity.

Thick oil contains much heteroatom such as sulfur, oxygen and nitrogen.

The content of the paraffin in the thick oil is generally low. However, very few oil fields are the "double-high oil fields" with high contents of both asphalt and paraffin, and are characterized by having crude oil with high viscosity and high solidifying point.

The properties of crude oil in the same thick oil reservoir often vary greatly between different well sections of a vertical oil layer and between different wells on the same plane.

With the continuous development of the drilling and completion technology and oil recovery technology in horizontal wells. The horizontal wells facilitate to improve output of the single wells, increase recoverable reserves and enhance oil recovery factor. Nowadays the horizontal wells development technology is used in various oil reservoirs. For homogeneous sandstone or carbonate oil reservoirs, traditional completion methods such as open hole completion, primary screen pipe completion and perforated completion give rise to some problems in the development of horizontal wells. As the producing horizontal section is relative long, the producing pressure is uneven in the whole horizontal section due to the effect of the frictional resistance in the wellbore. The producing pressure at the heel end is the largest while the producing pressure at the toe end is the smallest, resulting in uneven fluid production in the horizontal section, and even the situation that no fluid is produced at the toe end so as to significantly affect the development effect of the horizontal wells.

BRIEF SUMMARY OF THE INVENTION

The present invention provides a horizontal well completion tubing string capable of achieving sublevel mining to decrease the producing pressure at the heel end and increase the producing pressure at the toe end, enabling the horizontal section to uniformly produce fluid so as to achieve sublevel mining of the horizontal well.

According to some embodiments of the present invention, a horizontal well completion tubing string capable of achieving sublevel mining, comprising a L-shaped production casing comprising a vertical section and a horizontal section; a first primary screen pipe connected end-to-end to the horizontal section of the production casing; a middle casing connected end-to-end to the first primary screen pipe; a second primary screen pipe connected end-to-end to the middle casing; the middle casing disposed between the two primary screen pipes; a L-shaped pumping pipe is fixed to the vertical section of the production casing via a packer, an internal casing packer is installed in the middle casing, a horizontal section of the pumping pipe extends freely in a horizontal well section constituted of the two primary screen pipes and the middle casing, a secondary screen pipe is disposed on the horizontal section of the pumping pipe, the secondary screen pipe faces the first primary screen pipe, wherein the first primary screen pipe is connected to the horizontal section of the production casing with one end thereof, two external casing packers are installed on an outer wall of the middle casing, and an open hole is divided into three parts by the two external casing packers; a plurality of meshes formed on a sidewall of the secondary screen pipe, each mesh comprises a reduced section, and a straight section and an impact section that are connected sequentially and outwardly along a radial direction of the secondary screen pipe; an inner diameter of the reduced section is reduced outwardly along the radial direction of the secondary screen pipe, and an inner diameter of the impact section is reduced outwardly along the radial direction of the secondary screen pipe; and the two primary screen pipes each comprises a base pipe with a plurality of oil inlet holes arranged on an outer wall of the base pipe, a plurality of reinforcing ribs are disposed on an outer circumstance wall of the base pipe along an axial direction of the base pipe, a wrap wire is winded at intervals on the plurality of reinforcing ribs along a circumferential direction of the base pipe, and a triangular block shaped foam iron is filled between two adjacent reinforcing ribs of the plurality of reinforcing ribs.

In the prior art, during the thermal recovery of the thick oil, the longer the horizontal section of the horizontal well is, the larger the frictional resistance of the toe end of the horizontal well is, which the latter eventually causes uneven fluid production in the horizontal section. Namely, the producing pressure varies from the heel end to the toe end of the horizontal section, resulting in significant effect on the oil recovery efficiency. To solve such problem, the horizontal well in the present invention is provided with two external casing packers to divide the open hole into three parts. Thus the oil in the horizontal well flows into the periphery of the pumping pipe through each of the two primary screen pipes. Later, the oil passing through each of the two primary screen pipes flows respectively through the end of the pumping pipe and the secondary screen pipe disposed on the horizontal section of the pumping pipe. The oil is then transferred to an upper portion of the vertical section of the production casing so as to achieve sublevel mining of the horizontal well. The present invention employs the sublevel mining to decrease the frictional resistance of the produced fluid on the toe end of the horizontal well and increase producing pressure at the toe end. Meanwhile, the frictional resistance of the produced fluid on the heel end of the horizontal well is increased, and the producing pressure at the heel end is decreased. Consequently, the produced fluid in the horizontal section is produced relatively evenly, efficiently solving the problems caused by the traditional completion methods of the horizontal well such as uneven fluid production in the horizontal section and even no produced fluid on the toe end. The even fluid production in the horizontal well is realized, while the development effect of the horizontal well is improved.

Moreover, the oil in the open hole close to the end of the production casing is filtered via the two primary screen pipes and the secondary screen pipe, minimizing the content of the solids in the oil eventually flowing to the pumping pipe. When the well washing operation is carried out in the horizontal well completion at later stage of oil recovery, the flushing fluid is injected into the production casing to wash the pumping pipe, the two primary screen pipes and the secondary screen pipe, so as to ensure the oil recovery efficiency of the horizontal well completion at the later stage of oil recovery.

When the flushing fluid enters to the pumping pipe through the production casing, the flushing fluid in the pumping pipe to be ejected outwardly is subjected to large resistance due to the large reservoir pressure. For the two primary screen pipes, the flushing fluid is injected from the secondary screen pipe disposed on the horizontal section of the pumping pipe to one of the two primary screen pipes that is close to the production casing. The effect of unblocking meshes of the two primary screen pipes is difficult to be achieved by using the flushing fluid to eject to the exterior of one of the two primary screen pipes which faces to the secondary screen pipe. The inventor therefore improved the meshes of the secondary screen pipe. Namely, each of the meshes of the secondary screen pipe comprises a reduced section, a straight section and an impact section which are sequentially connected. The inner diameter of the reduced section or the impact section is reduced outwardly along the radial direction of the secondary screen pipe, while the inner diameter of the straight section remains unchanged. When the flushing fluid overflows from the pumping pipe, the flow velocity thereof would increase gradually as the abrupt decrease in the flow cross section. After smooth transited in the straight section, the flushing fluid is accelerated in the impact section again. Meanwhile, compared with the common meshes, the interior of the secondary screen pipe is subjected to a smaller reservoir pressure in the horizontal well. Namely, the flushing fluid eventually overflowing from the impact section and remaining in a state of high flow velocity starts to wash the primary screen pipes. At the same time, the solid particles blocking in the secondary screen pipe and the primary screen pipes are washed away by the powerful flushing fluid, remaining unblocked in the meshes of the secondary screen pipe and the primary screen pipes.

When in use, the base pipe is placed in the horizontal section of the horizontal well completion, and thick oil enters into the gaps between the wrap wire and the casing through the wrap wire gap. After filtered by the foam iron, the thick oil enters into the base pipe through the plurality of oil inlet holes, realizing pumping and transportation of the oil. In the prior art, steam flooding technology has been used in the recovery of thick oil. Namely, a steam injection well and a production well are set above an oil reservoir; steam is continuously injected into the steam injection well to heat the strata around the wellbore and the crude oil in the strata. A steam zone gradually expanding with the continuous injection of steam is formed in the strata near the wellbore. The steam can reduce oil saturation of the steam zone to a lower degree, and drive the flowable crude oil (that is, the difference between original oil saturation and residual oil saturation) out of the steam zone. Meanwhile, the steam moves vigorously toward an updip direction; and as driven by gravity, the heated crude oil moves toward a downdip direction. With the increase in temperature of the crude oil, oil-water and gravel mixture in the horizontal section of the horizontal well completion would boil, causing denudation of the crude oil (by disturbance caused by boiling of the mixture). The oil-water and solid mixtures begin to enter into a base pipe from the horizontal section of the horizontal well completion. A wrap wire is a full metal bar and winded at intervals on the plurality of reinforcing ribs to form a primary filter unit for solid gravels with large diameter in the oil-water. A foam iron forms a second filter unit for solid gravels with small diameter to realize the purpose of sand control for the base pipe. Moreover, when change in producing pressure of the horizontal section of the horizontal well completion occurs due to the influence of liquid pressure and heat contained in the oil-water, a second filter zone formed between two adjacent reinforcing ribs of the plurality of reinforcing ribs would be compressed. However, a triangular block shaped foam iron is filled in the second filter zone; when deformation of the foam iron occurs under stress, a plurality of flow channels with irregular geometric shapes would still form in the second filter zone to allow the oil-water mixture to pass through. In addition, when stressed, pore channels in the foam iron change slightly and are not easy to be fully blocked. Meanwhile, as the foam iron has a certain degree of elasticity, the pore channels in the foam iron would recover when elastic deformation is restored so that the seepage capacity of the second filter zone can be maintained to ensure successful recovery of the thick oil.

According to yet another embodiment of the present invention, in the radial direction of the secondary screen pipe, a length of the reduced section, a length of the straight section and a length of the impact section are increased sequentially. The length of the reduced section, the length of the straight section and the length of the impact section in the radial direction of the secondary screen pipe directly relate to the ejected velocity of the flushing fluid at the secondary screen pipe. Namely, in the meshes, the greater the increase in the velocity of the flushing fluid is, the larger the impact applies on the two primary screen pipes. In the present invention, the length of the reduced section, the length of the straight section and the length of the impact section are increased outwardly along the radial direction of the secondary screen pipe, prolonging the acceleration time of the flushing fluid in the meshes, completely eliminating the solid particles blocked in the two primary screen pipes and the secondary screen pipe with the powerful flushing fluid. Consequently, a stable output of the produced fluid at the later stage of the recovery in the horizontal well completion can be ensured.

In some embodiments, a releasing tool is comprised. The releasing tool is connected to an upper end of the packer via a screw thread. After connected to the packer, the releasing tool can directly butt to the pumping pipe disposed in an intermediate casing. Meanwhile, the packer divides a vertical portion of a first pipeline into an upper portion and a lower portion, wherein an oilhole is provided on the lower portion and the releasing tool is disposed on the upper portion. After flows into the oilhole, the produced fluid flowing into a first section of one of the primary screen pipes directly mixes with the produced fluid flowing into a second pipeline. A mixture of the two produced fluid is then collected in the releasing tool and is discharged out of the well.

In some embodiments, the horizontal well completion tubing string further comprises a plurality of stiffeners annularly disposed on the wrap wire along the axial direction of the base pipe. In the horizontal section of the horizontal well completion, the wrap wire is pressured not only by the oil layer, and the pressure varies constantly with the change in oil layer temperature. That is, during sudden changes in the pressure, the wrap wire is extremely vulnerable to damage. However, in the present invention, a plurality of stiffeners are annularly disposed on the wrap wire, providing a stable support for the primary filter unit formed by the wrap wire to cope with the constantly changing production pressure in the horizontal section of the horizontal well completion and extend the service life of the wrap wire.

According to another embodiment of the present invention, an outer wall of the wrap wire is coated with a TiALN—WC/C coating. Preferably, the outer wall of the wrap wire is disposed with a TiALN—WC/C coating. As the friction coefficient of the TiALN—WC/C coating is only 0.1. When the solids such as gravel continuously contact with the wrap wire, the TiALN—WC/C coating can significantly reduce friction loss between the solids and the wrap wire. Meanwhile, the TiALN—WC/C coating is self-lubricating, greatly ensuring the service life of the wrap wire in the horizontal well completion.

In some embodiments, the horizontal well completion tubing string further comprises a connecter, wherein each of two ends of the base pipe is connected with a blind pipe through the connector. Preferably, according to the actual needs in oil recovery, the base pipe is connected with the blind pipe through the connector for facilitating the pumping and transportation of crude oil. The present invention abandons direct welding of the blind pipe to the base pipe as adopted in the conventional art when laying the pipeline so as to facilitate the replacement of damaged wrap wires without having to replace the base pipe and the wrap wire entirely, therefore reducing the production cost in thick oil recovery.

As compared to the existing art, the present invention has the following advantages and beneficial effects:

In the present invention, the oil in the open hole close to the end of the production casing is filtered via the two primary screen pipes and the secondary screen pipe, minimizing the content of the solids in the oil eventually flowing into the pumping pipe. When the well washing operation is carried out in the horizontal well completion at later stage of oil recovery, the flushing fluid is injected in to production casing to wash the pumping pipe, the two primary screen pipes and the secondary screen pipe, ensuring the oil recovery efficiency of the horizontal well completion at the later stage of oil recovery.

For making the above and other purposes, features, benefits become more readily apparent to those ordinarily skilled in the art, the preferred embodiments and the detailed descriptions with accompanying drawings would be put forward in the following descriptions.

BRIEF DESCRIPTION OF THE DRAWINGS

The figures described herein are used to provide a further understanding of the embodiments of the present invention and constitute a part of the present application but without limiting the embodiments of the present invention. In the figures.

DETAILED DESCRIPTION OF THE PREFERRED EMBODIMENTS

The present invention would now be described more specifically with reference to the following embodiment. It is to be noted that the following descriptions of preferred embodiment of the present invention are presented herein for purpose of illustration and description only. It is not intended to be exhaustive or to be limited to the precise form disclosed.

Figure 1:
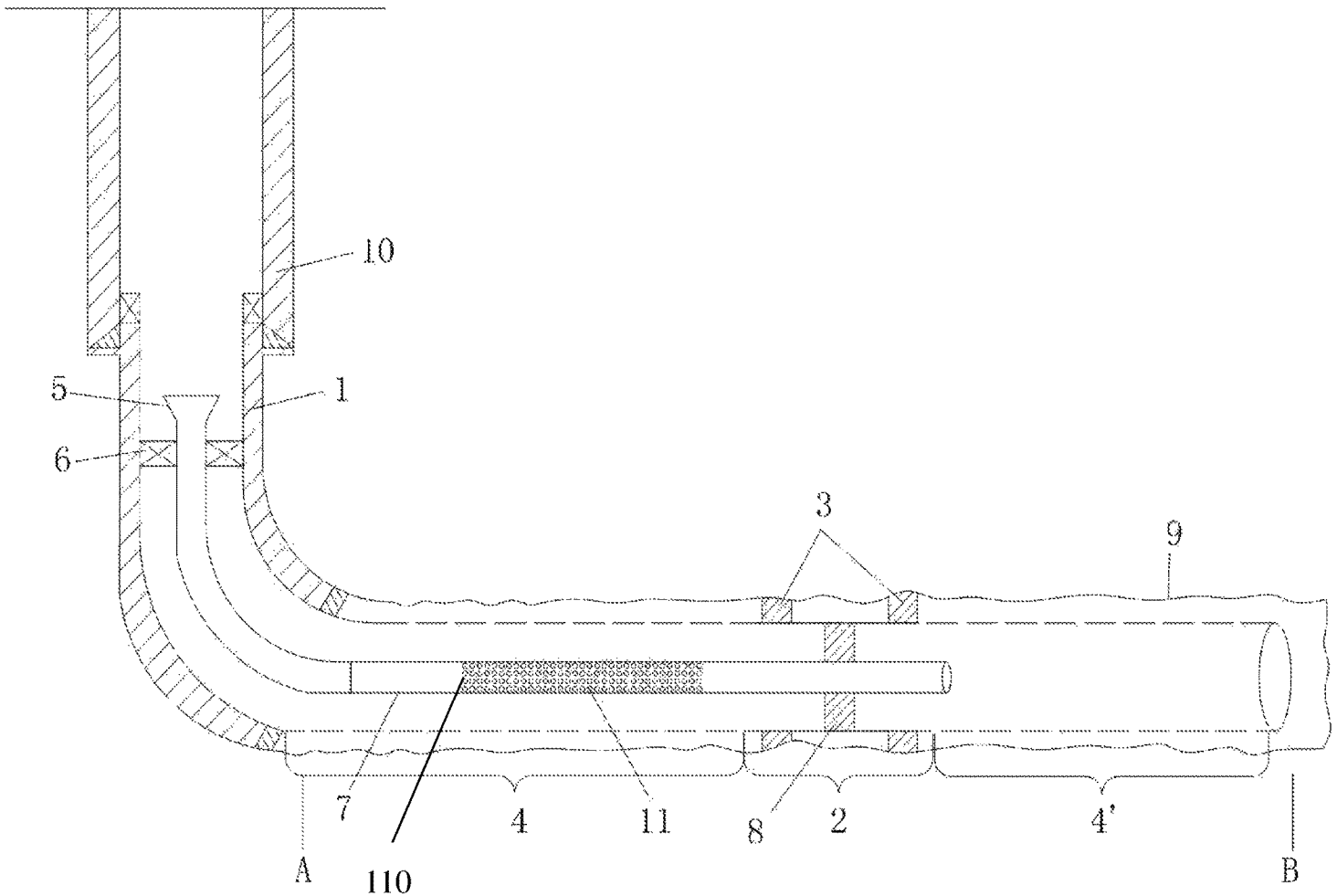
FIG. 1 is a schematic structure diagram of the present invention.
Figure 2:
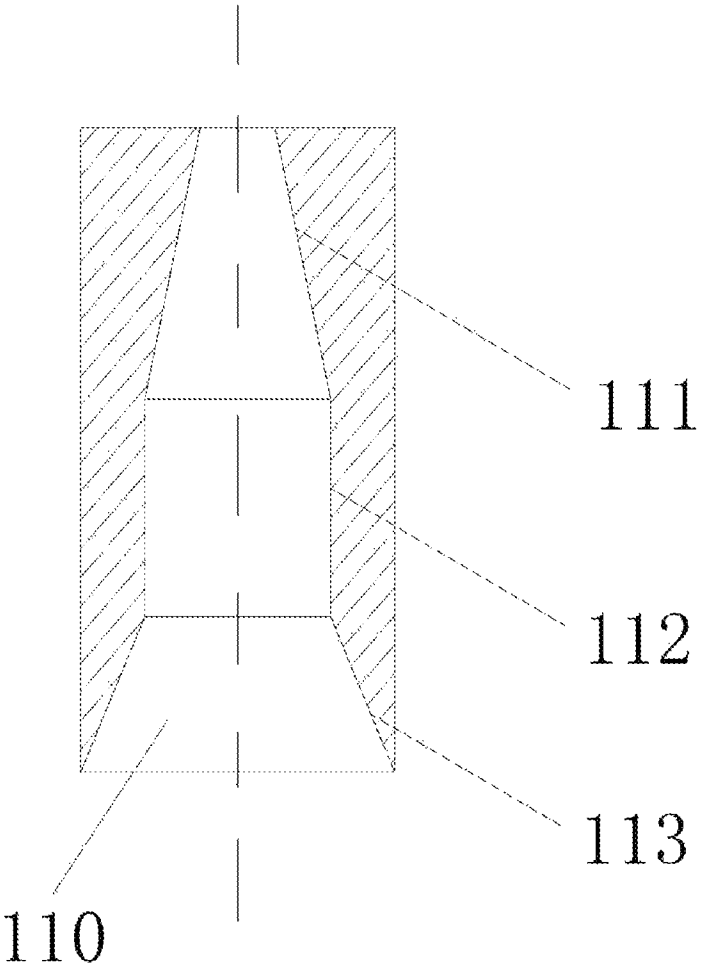
FIG. 2 is a schematic structure diagram of the secondary screen pipe.
Figure 3:
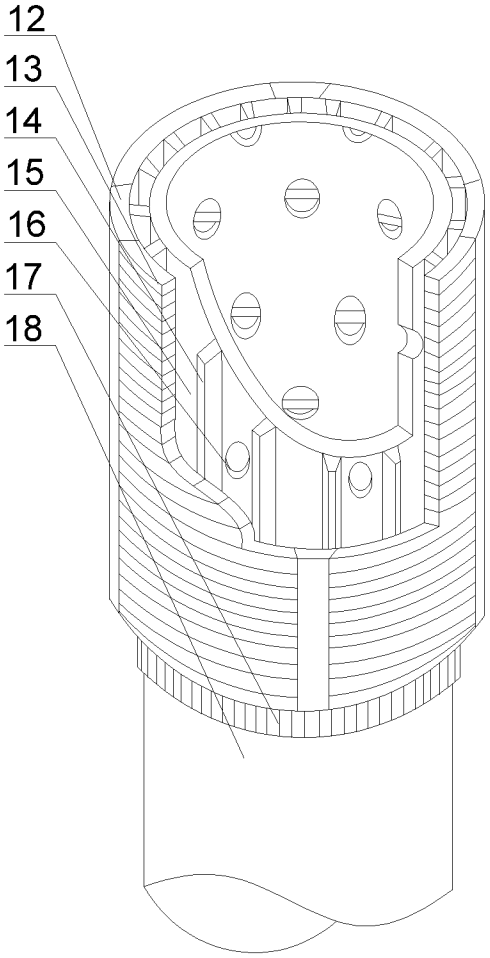
FIG. 3 is a schematic structure diagram of one of the two primary screen pipes.
Figure 4:
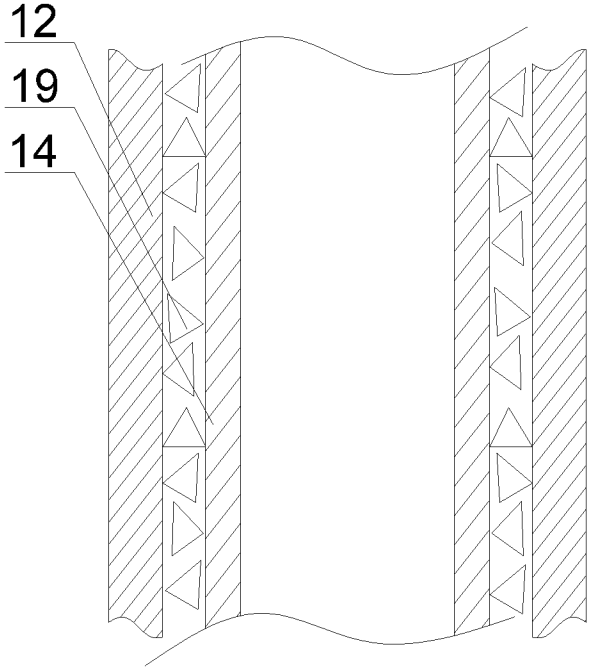
FIG. 4 is a longitudinal cross-sectional view of one of the two primary screen pipes.

As shown in FIG. 1 to FIG. 4, the present embodiment comprises a L-shaped production casing 1. The L-shaped production casing 1 includes a vertical section and a horizontal section. A first primary screen pipe 4 is connected end-to-end to the horizontal section of the production casing 1, a middle casing 2 is connected end-to-end to the first primary screen pipe 4, and a second primary screen pipe 4' is connected end-to-end to the middle casing 2. The middle casing 2 is disposed between the two primary screen pipes 4, 4'. A L-shaped pumping pipe 7 is fixed to the vertical section of the production casing 1 via a packer 6. An internal casing packer 8 is installed in the middle casing 2. A horizontal section of the pumping pipe 7 extends freely in a horizontal well section constituted of the two primary screen pipes 4, 4' and the middle casing 2. A secondary screen pipe 11 is disposed on the horizontal section of the pumping pipe 7. The secondary screen pipe 11 faces the first primary screen pipe 4, wherein the first primary screen pipe 4 is connected to the horizontal section of the production casing 1 with one end thereof. Two external casing packers 3 are installed on an outer wall of the middle casing 2, and an open hole 9 is divided into three parts by the two external casing packers 3. A plurality of meshes 110 is formed on a sidewall of the secondary screen pipe 11 each mesh 110 comprises a reduced section 113, a straight section 112 and an impact section 111 that are connected sequentially and outwardly along a radial direction of the secondary screen pipe 11. An inner diameter of the reduced section 113 is reduced outwardly along the radial direction of the secondary screen pipe 11, while an inner diameter of the impact section 111 is reduced outwardly along the radial direction of the secondary screen pipe 11. The two primary screen pipes 4 each comprises a base pipe 15 with a plurality of oil inlet holes 16 arranged on an outer wall of the base pipe 15. A plurality of reinforcing ribs 14 are disposed on an outer circumstance wall of the base pipe 15 along an axial direction of the base pipe 15. And a wrap wire 13 is winded at intervals on the plurality of reinforcing ribs 14 along a circumferential direction of the base pipe 15. A triangular block shaped foam iron 19 is filled between two adjacent reinforcing ribs 14 of the plurality of reinforcing ribs 14.

In the prior art, during the thermal recovery of the thick oil, the longer the horizontal section of the horizontal well is, the lager the frictional resistance of the toe end B of the horizontal well is, which the latter eventually causes uneven fluid production in the horizontal section. Namely, the producing pressure varies from the heel end A to the toe end B of the horizontal section so as to significantly affect the oil recovery efficiency. To solve such problem, the horizontal well in the present invention is provided with two external casing packers 3 to divide the open hole 9 into three parts. Thus the oil in the horizontal well flows into the periphery of the pumping pipe 7 through each of the two primary screen pipes. Later, the oil passing through each of the two primary screen pipes flows respectively through the end of the pumping pipe 7 and the secondary screen pipe 11 disposed on the horizontal section of the pumping pipe 7. The oil is then transferred to the upper portion of the vertical section of the production casing 1 so as to achieve sublevel mining of the horizontal well. The present invention employs the sublevel mining to decrease the frictional resistance of the produced fluid on the toe end B of the horizontal well and increase producing pressure at the toe end B. Meanwhile, the frictional resistance of the produced fluid on the heel end A of the horizontal well is increased, and the producing pressure at the heel end A is decreased. Consequently, the produced fluid in the horizontal section is produced relatively evenly, efficiently solving the problems caused by the traditional completion methods of the horizontal well such as uneven fluid production in the horizontal section and even no produced fluid on the toe end B. The even fluid production in the horizontal well is implemented, while the development effect of the horizontal well is improved. Moreover, the oil in the open hole close to the end of the production casing is filtered via the two primary screen pipes and the secondary screen pipe, minimizing the content of the solids in the oil eventually flowing to the pumping pipe 7. When the well washing operation is carried out in the horizontal well completion at later stage of oil recovery, the flushing fluid is injected into the production casing 1 to wash the pumping pipe 7, the two primary screen pipes and the secondary screen pipe 11, so as to ensure the oil recovery efficiency of the horizontal well completion at the later stage of oil recovery.

When the flushing fluid enters to the pumping pipe 7 through the production casing 1, the flushing fluid in the pumping pipe 7 to be ejected outwardly is subjected to large resistance due to the large reservoir pressure. For the two primary screen pipes, the flushing fluid is injected from the secondary screen pipe disposed on the horizontal section of the pumping pipe 7 to one of the two primary screen pipes that is close to the production casing 1. The effect of unblocking meshes of the two primary screen pipes is difficult to be achieved by using the flushing fluid to eject to the exterior of one of the two primary screen pipes which faces to the secondary screen pipe. The inventor therefore improved the meshes of the secondary screen pipe 11. Namely, each of the meshes of the secondary screen pipe 11 comprises a reduced section 113, a straight section 112 and an impact section 111 which are sequentially connected. The inner diameter of the reduced section 113 or the impact section 111 is reduced outwardly along the radial direction of the secondary screen pipe 11, while the inner diameter of the straight section 112 remains unchanged. When the flushing fluid overflows from the pumping pipe 7, the flow velocity thereof would increase gradually as the abrupt decrease in the flow cross section. After smooth transited in the straight section 112, the flushing fluid is accelerated in the impact section 111 again. Meanwhile, compared with the common meshes, the interior of the secondary screen pipe 11 is subjected to a smaller reservoir pressure in the horizontal well. Namely, the flushing fluid eventually overflowing from the impact section 111 and remaining in a state of high flow velocity starts to wash the two primary screen pipes. At the same time, the solid particles blocking in the secondary screen pipe 11 and the two primary screen pipes are washed away by the powerful flushing fluid, remaining unblocked in the meshes of the secondary screen pipe 11 and the two primary screen pipes.

When in use, the base pipe 15 is placed in the horizontal section of the horizontal well completion, and thick oil enters into the gaps between the wrap wire 13 and the casing through the wrap wire gap 13. After filtered by the foam iron 19, the thick oil enters into the base pipe 15 through the plurality of oil inlet holes 16, realizing pumping and transportation of the oil. In the prior art, steam flooding technology has been used in the recovery of thick oil. Namely, a steam injection well and a production well are set above an oil reservoir; steam is continuously injected into the steam injection well to heat the strata around the wellbore and the crude oil in the strata. A steam zone gradually expanding with the continuous injection of steam is formed in the strata near the wellbore. The steam can reduce oil saturation of the steam zone to a lower degree, and drive the flowable crude oil (that is, the difference between original oil saturation and residual oil saturation) out of the steam zone. Meanwhile, the steam moves vigorously toward an updip direction; and as driven by gravity, the heated crude oil moves toward a downdip direction. With the increase in temperature of the crude oil, oil-water and gravel mixture in the horizontal section of the horizontal well completion would boil, causing denudation of the crude oil (by disturbance caused by boiling of the mixture). The oil-water and solid mixtures begin to enter into a base pipe 15 from the horizontal section of the horizontal well completion. The wrap wire 13 is a full metal bar and winded at intervals on the plurality of reinforcing ribs 14 to form a primary filter unit for solid gravels with large diameter in the oil-water. A foam iron 19 forms a second filter unit for solid gravels with small diameter to realize the purpose of sand control for the base pipe 15. Moreover, when change in producing pressure of the horizontal section of the horizontal well completion occurs due to the influence of liquid pressure and heat contained in the oil-water, a second filter zone formed between two adjacent reinforcing ribs 14 of the plurality of reinforcing ribs 14 would be compressed. However, a triangular block shaped foam iron 19 is filled in the second filter zone; when deformation of the foam iron 19 occurs under stress, a plurality of flow channels with irregular geometric shapes would still form in the second filter zone to allow the oil-water mixture to pass through. In addition, when stressed, pore channels in the foam iron 19 change slightly and are not easy to be fully blocked. Meanwhile, as the foam iron 19 has a certain degree of elasticity, the pore channels in the foam iron 19 would recover when elastic deformation is restored so that the seepage capacity of the second filter zone can be maintained to ensure successful recovery of the thick oil.

Preferably, in the radial direction of the secondary screen pipe 11, a length of the reduced section 113, a length of the straight section 112 and a length of the impact section 111 are increased sequentially. The length of the reduced section 113, the length of the straight section 112 and the length of the impact section 111 in the radial direction of the secondary screen pipe 11 directly relate to the ejected velocity of the flushing fluid at the secondary screen pipe 11. Namely, in the meshes, the greater the increase in the velocity of the flushing fluid is, the larger the impact applies on the two primary screen pipes. In the present invention, the length of the reduced section 113, the length of the straight section 112 and the length of the impact section 111 are increased outwardly along the radial direction of the secondary screen pipe 11, prolonging the acceleration time of the flushing fluid in the meshes, completely eliminating the solid particles blocked in the two primary screen pipes and the secondary screen pipe 11 with the powerful flushing fluid.

Consequently, a stable output of the produced fluid at the later stage of the recovery in the horizontal well completion can be ensured.

The present invention further comprises a releasing tool 5. The releasing tool 5 is connected to an upper end of the packer 6 via a screw thread. After connected to the packer 6, the releasing tool 5 can directly butt to the pumping pipe 7 disposed in an intermediate casing 10. Meanwhile, the packer 6 divides a vertical portion of a first pipeline into an upper portion and a lower portion, wherein an oilhole is provided on the lower portion and the releasing tool 5 is disposed on the upper portion. After flows into the oilhole, the produced fluid flowing into a first section of one of the two primary screen pipes directly mixes with the produced fluid flowing into a second pipeline. A mixture of the two produced fluid is then collected in the releasing tool 5 and is discharged out of the well.

The present embodiment further comprises a plurality of stiffeners 12 annularly disposed on the wrap wire 13 along the axial direction of the base pipe 15. In the horizontal section of the horizontal well completion, the wrap wire 13 is pressured not only by the oil layer, and the pressure varies constantly with the change in oil layer temperature. That is, during sudden changes in the pressure, the wrap wire 13 is extremely vulnerable to damage. However, in the present invention, a plurality of stiffeners 12 are annularly disposed on the wrap wire 13, providing a stable support for the primary filter unit formed by the wrap wire 13 to cope with the constantly changing production pressure in the horizontal section of the horizontal well completion and extend the service life of the wrap wire.

Preferably, an outer wall of the wrap wire 13 is coated with a TiALN—WC/C coating. As the friction coefficient of the TiALN—WC/C coating is only 0.1. When the solids such as gravel continuously contact with the wrap wire 13, the TiALN—WC/C coating can significantly reduce friction loss between the solids and the wrap wire 13. Meanwhile, the TiALN—WC/C coating is self-lubricating, greatly ensuring the service life of the wrap wire 13 in the horizontal well completion.

Preferably, according to the actual needs in oil recovery, the base pipe 15 is connected with a blind pipe 18 through a connector 17 for facilitating the pumping and transportation of crude oil. Also, the present invention abandons direct welding of the blind pipe 18 to the base pipe 15 as adopted in the conventional art when laying the pipeline so as to facilitate the replacement of damaged wrap wires without having to replace the base pipe 15 and the wrap wire 13 entirely, therefore reducing the production cost in thick oil recovery.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A horizontal well completion tubing string capable of achieving sublevel mining, comprising:

a L-shaped production casing comprising a vertical section and a horizontal section;

a first primary screen pipe connected end-to-end to the horizontal section of the production casing;

a middle casing connected end-to-end to the first primary screen pipe;

a second primary screen pipe connected end-to-end to the middle casing;

the middle casing disposed between the two primary screen pipes;

a L-shaped pumping pipe fixed to the vertical section of the production casing via a packer;

an internal casing packer installed in the middle casing;

a horizontal section of the pumping pipe extending freely in a horizontal well section constituted of the two primary screen pipes and the middle casing;

a secondary screen pipe disposed on the horizontal section of the pumping pipe, and facing the first primary screen pipe, wherein the first primary screen pipe is connected to the horizontal section of the production casing with one end thereof;

two external casing packers installed on an outer wall of the middle casing;

an open hole divided into three parts by the two external casing packers;

a plurality of meshes formed on a sidewall of the secondary screen pipe, each mesh comprising:

a reduced section, a straight section and an impact section, wherein the reduced section, the straight section and the impact section are connected sequentially and outwardly along a radial direction of the secondary screen pipe; and an inner diameter of the reduced section is reduced outwardly along the radial direction of the secondary screen pipe, and an inner diameter of the impact section is reduced outwardly along the radial direction of the secondary screen pipe; and the two primary screen pipes each comprising:

a base pipe with a plurality of oil inlet holes arranged on an outer wall of the base pipe, a plurality of reinforcing ribs disposed on an outer circumstance wall of the base pipe along an axial direction of the base pipe, a wrap wire winded at intervals on the plurality of reinforcing ribs along a circumferential direction of the base pipe, and a triangular block shaped foam iron filled between two adjacent reinforcing ribs of the plurality of reinforcing ribs.

2. The horizontal well completion tubing string capable of achieving sublevel mining as claimed in claim 1, wherein in the radial direction of the secondary screen pipe, a length of the reduced section, a length of the straight section and a length of the impact section are increased sequentially.

3. The horizontal well completion tubing string capable of achieving sublevel mining as claimed in claim 1, further comprising a releasing tool connected to an upper end of the packer via a screw thread.

4. The horizontal well completion tubing string capable of achieving sublevel mining as claimed in claim 1, further comprising a plurality of stiffeners annularly distributed on the wrap wire along the axial direction of the base pipe.

5. The horizontal well completion tubing string capable of achieving sublevel mining as claimed in claim 1, wherein an outer wall of the wrap wire is coated with a TiALN—WC/C coating.

6. The horizontal well completion tubing string capable of achieving sublevel mining as claimed in claim 1, further comprising a connector, wherein each of two ends of the base pipe is connected with a blind pipe through the connector.

* * * * *